United States Patent [19]

Dietrich

[11] 4,420,133

[45] Dec. 13, 1983

[54] DEVICE FOR THE TRANSMISSION OF INFORMATION THROUGH THE RAILS BETWEEN A RAILWAY TRACK AND A GROUP OF VEHICLES RUNNING ALONG THIS TRACK

[75] Inventor: Michel J. Dietrich, Le Plessis Belleville, France

[73] Assignee: Jeumont-Schneider, Puteaux, France

[21] Appl. No.: 193,272

[22] PCT Filed: Jul. 2, 1979

[86] PCT No.: PCT/FR79/00057

§ 371 Date: Mar. 17, 1980

§ 102(e) Date: Mar. 17, 1980

[87] PCT Pub. No.: WO80/00239

PCT Pub. Date: Feb. 21, 1980

[30] Foreign Application Priority Data

Jul. 17, 1978 [FR] France ..... 78 21168

[51] Int. Cl.[3] ..... B61L 3/00; B61L 21/00

[52] U.S. Cl. ..... 246/167 R; 246/34 CT; 246/63 C

[58] Field of Search ..... 246/3, 34 R, 34 CT, 246/63 R, 63 C, 63 A, 28 R, 28 K, 167 R, 187 B, 122 R; 340/310 R

[56] References Cited

U.S. PATENT DOCUMENTS

| | | | |
|---|---|---|---|
| 3,390,256 | 6/1968 | Clanton et al. | 246/28 R |
| 3,450,874 | 6/1969 | Whitten | 246/130 |
| 3,493,741 | 2/1970 | Lubich | 246/63 R |
| 3,543,262 | 11/1970 | Hutton | 246/34 CT |
| 3,949,959 | 4/1976 | Rhoton et al. | 246/34 CT |
| 3,974,991 | 8/1976 | Geiger | 246/34 CT |

FOREIGN PATENT DOCUMENTS 1451431 10/1976 United Kingdom .

*Primary Examiner*—James J. Groody

*Attorney, Agent, or Firm*—Schwartz, Jeffery, Schwaab, Mack, Blumenthal & Koch

[57] ABSTRACT

A system for transmitting data long rails of a railway track for reception by a receiver mounted on a vehicle of the train. The system includes resonance circuits defining contiguous zones which are independent of a block system of the railway track. An insulative conductive loop is placed between the rails of the track and proximate the resonance circuits. An AC generator and modulation are provided to produce a modulated carrier frequency corresponding to the data to be transmitted and is coupled to the conductive loop. The receiver is positioned at the front of the train when the conductive loop is positioned near the downstream side of each zone and toward the rear of the train when the conductive loop is positioned toward the upstream side of each zone relative to the direction of train travel.

12 Claims, 4 Drawing Figures

DEVICE FOR THE TRANSMISSION OF INFORMATION THROUGH THE RAILS BETWEEN A RAILWAY TRACK AND A GROUP OF VEHICLES RUNNING ALONG THIS TRACK

A device for transmission of information, the propagation zones for the information signals of which are independent of the sections of the block system.

A generator 11 of alternating signals modulated at 12 by signals 13 to be transmitted is coupled to the lines of rails 1 and 2 by induction, by means of a winding 6 downstream of the zone. Each zone for transmission of information is bounded upstream and downstream by resonant circuits 4 and 5 tuned to the carrier frequency of the signals transmitted. This frequency is chosen so as to avoid any interaction between the track circuits and the device for transmission of information.

BACKGROUND OF THE INVENTION

The present invention refers to a device for the transmission of information through the rails between a railway track and a group of vehicles running in the same direction along this track over the length of which a plurality of zones for the transmission of information succeed one another.

Railway tracks and mainly those having heavy traffic are usually equipped with a block system, especially by track circuits, which in general employs the running rails as the path of transmission.

In modern equipment it has become necessary to have a device for transmission of information between the track and the vehicles. Such a device is capable of coexisting with the block system and, the whole system operating in a fail-safe manner in the railway sense of this term.

A known solution consists in transmitting the information by induction from a cable arranged in the track or along it, but this solution offers a certain number of disadvantages: the costs of the cable and the restraints which result from it in the maintenance of the track.

The employment of the running rails as the transmission path causes these disadvantages to disappear but comes up against two difficulties. The first difficulty arises.

From the fact that the running rails serve as the return circuit for the traction current with electrified lines and very often as the transmission path for the block signals.

Hence the signals of any system of transmission of information through the rails must be superimposed upon these existing currents and signals without disturbing them and must be able to be separated from them.

The difficulty is connected with the division of the track into blocks. This division must not affect the transmission of the information, of which the zones of transmission when this is effected by zones which succeed one another along the track, must be able to be demarcated independently of the sections of the block system.

SUMMARY OF THE INVENTION

The device in accordance with the invention enables one to free oneself of these difficulties because it employs for transmitting the information an alternating carrier wave modulated in frequency or in amplitude or in both and of characteristics such that its propagation in the rails is not affected by the return traction currents and by the block signals as well as by the device demarcating the blocks; further, it enables a demarcation of its own zones of propagation independently of the sections of the block system.

This device is characterized in that it includes:

(1) on the track, for each zone for the transmission of information: p1 (a) a generator of alternating signals at a predetermined frequency which forms the carrier frequency of the information to be transmitted this frequency being taken from outside the bands of frequency employed in the block system;
   (b) a modulator of the said signals;
   (c) a member for operation of the modulator so that these signals are modulated as a function of the information to be transmitted;
   (d) an insulated conductive winding arranged in the form of a loop between the two lines or rails, near to the downstream end of the said zone for the transmission of information;
   (e) an impedance-adapter and circuit-separating transformer the primary of which receives the modulated signals and the secondary of which is connected to the terminals of the loop-shaped winding;
   (f) two resonant circuits tuned to the carrier frequency, connected between the two lines of rails, one to the downstream end and the other to the upstream end of the zone for the transmission of information; and (2) and on board each vehicle: receiver means tuned to the respective carrier frequencies of the zones for the transmission of information.

BRIEF DESCRIPTION OF THE DRAWINGS

The invention will be better understood with the aid of some specific embodiment as illustrated in the drawings in which.

DETAIL DESCRIPTION OF THE PREFERRED EMBODIMENTS

Figure 1:
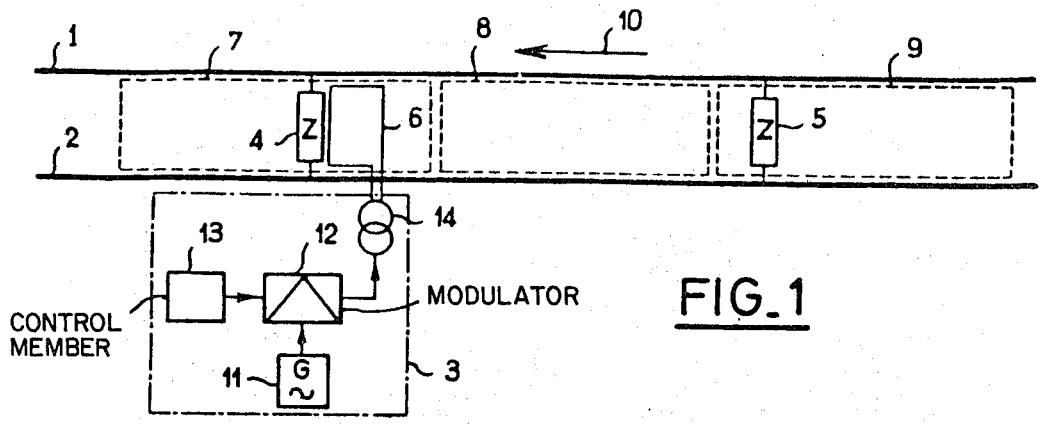
FIG. 1 represents the case of a single device for transmission of information.

FIG. 1 represents a section of railway track which includes only one zone for transmission of information. The references 1 and 2 designate the lines of rails. The transmitter circuit 3 for this information, represented by in dash-dot lines, is located on the track close to the downstream end of the transmission zone which is demarcated by the lines of rails 1 and 2 and by two resonant circuits represented by the impedances 4 and 5 at the two ends of this zone. The transmitter circuit 3 is connected to the terminals of an insulated conductive winding 6 arranged in the form of a loop between the two lines of rails 1 and 2 close to the impedance 4 located at the downstream end of the transmission zone. By way of indication, three sections 7,8,9 of the block system have been shown. It is a question, for example, of the sections covered by three successive track circuits. It may be seen in FIG. 1 that these three sections have limits which do not coincide with those of the zone for transmission of information, bounded by the impedances 4 and 5. The arrow 10 shows the direction of movement of the vehicles on the track.

The transmitter circuit 3 includes a generator 11 of alternating signals which serves as the carrier wave for the information to be transmitted and which feeds a modulator 12 which receives, from a control member 13 the necessary modulating signal in order that the modulation is effected as a function of the information to be transmitted. The modulated signal is transmitted to the loop-shaped winding 6 by way of a transformer 14 which plays the part of an impedance-adaptor and circuit-separator.

The carrier wave frequency is determined so as to lie outside the bands of frequency employed in the track circuits 7,8, 9.

Carrier frequencies will be chosen, for example, of the order of a kilohertz.

The impedances 4 and 5 consist of an inductance in series with a capacitor, so as to produce a resonant circuit the impedance of which is a minimum for the frequency of the carrier-wave of the transmitter 3. Hence these impedances do not allow the block signals to pass.

The signal transmitted into the winding 6 is transmitted by induction to the loop consisting of the two lines of rails 1 and 2, and the impedances 4 and 5 act practically as a short-circuit between the lines 1 and 2.

Each vehicle includes, for example, as a receiver circuit a pick-up tuned to the frequency of the carrier wave of the signals transmitted and receiving them by induction.

Figure 2:
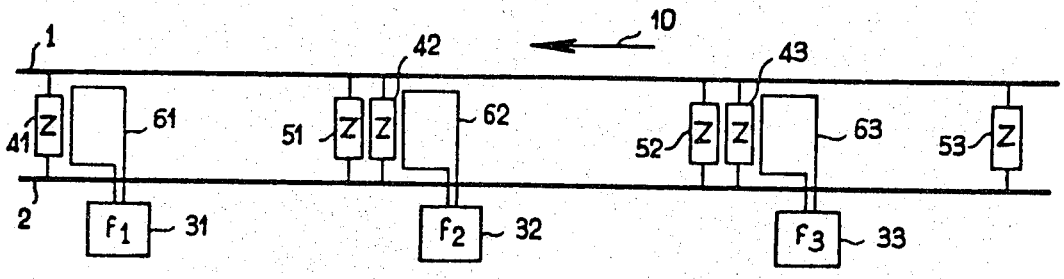
FIG. 2 illustrates the case of a series of similar devices distributed along the track.

FIG. 2 shows three successive transmission zones, similar to that of FIG. 1, forming part of a series of transmission zones distributed along the track. The numerical references employed are numbers of two digits, the tens digit corresponding with the similar component in FIG. 1 and the units digit representing the number of the zone in order. The first zone has as its carrier wave frequency the frequency f1, the second the frequency f2 and the third the frequency f3. These frequencies are considered here as different, but they may also be equal. When they are different the vehicle is equipped with as many pick-ups on board as there are distinct frequencies employed.

Figure 3:
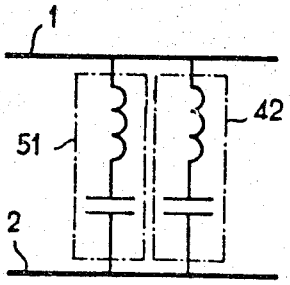
FIG. 3 shows the detail of the resonant circuits between the lines of rails at a point of transition between two consecutive zones of transmission.

FIG. 3 indicates the detail of the upstream impedance 51 of the first zone, which is a resonant circuit tuned to the frequency f1, and the downstream impedance 42 of the second zone which is a resonant circuit tuned to the frequency f2.

In the case where the frequencies f1,f2,f3 are equal the diagram of FIG. 3 is reduced to a single resonant circuit tuned to the signal carrier frequency employed.

Figure 4:
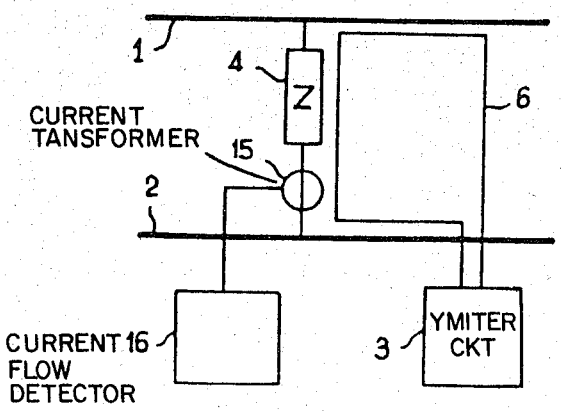
FIG. 4 illustrates a complementary control circuit applicable to the preceding cases.

When there is a need to check, in order to increase the reliability of the device, for example, whether a current is flowing in the loop 6 of a zone, one determines whether an induced current is flowing in the loop formed by the lines of rails 1 and 2 and the impedances 4 and 5. In this case (see FIG. 4), a control circuit is added, consisting of a current transformer 15 the primary of which is inserted in series between the impedance 4 and the line of rails 2 and the secondary of which is connected to a current flow detector 16.

In what has gone before it has been assumed that in each zone for transmission of information only one carrier wave frequency was being employed. It is possible without departing from the scope of the invention to employ in the same zone a number of carrier frequencies, for example, by switching onto the winding 6 different transmitter circuits such as 3, each of them corresponding with a particular carrier frequency. In this case the impedances corresponding with 4 and 5 would consist of as many resonant circuits in parallel as there are distinct carrier frequencies, each of these frequencies corresponding with only one resonant circuit tuned to it.

Finally it is possible to superimpose in one and the same zone for transmission of information two devices in accordance with the invention, one for each direction of movement of the vehicles, with, for example, the same carrier frequency.

I claim:

1. A system for transmission of data along the rails of a railway track through a plurality of successive, contiguous zones, said data transmitted to a train passing along said track in a given direction of travel, said system comprising:

(1) a plurality of resonance circuits, each connected across the rails of said zone, pairs of said resonance circuits defining said zones therebetween, and said zones being independent of a block system of said railway track, (2) an alternating current generator for each zone having a predetermined frequency outside frequency bands of said block system, said predetermined frequency producing a carrier frequency for the data to be transmitted.

(3) for each given zone, said pairs of said resonance circuits defining the given zone tuned to the carrier frequency of said generator within said given zone, (4) means for modulating said carrier frequency for each zone corresponding to the data to be transmitted thereby providing a data signal for each zone, (5) a plurality of insulated conductive windings in the form of conductive loops, one of said windings within each zone and positioned between the rails of said tracks adjacent the downstream side of each zone with respect to the direction of train travel, for each given zone said one winding positioned immediately proximate one of said pairs of resonance circuits of said given zone and remote from the other of said pair of resonance circuits of said given zone, (6) means for coupling the winding within each zone to receive the data signal from the modulating means of each zone, and (7) a receiver mounted onboard said train at a position near the forward end of said train along the direction of travel of said train, said receiver tuned to the respective carrier frequencies of each zone for receiving the data signals of each zone.

2. A system as recited in claim 1 wherein said predetermined frequencies of each zone are all equal.

3. A system as recited in claim 1 wherein said predetermined frequencies of each zone are all different.

4. A system as recited in claim 1 wherein for each zone, said coupling means comprises an impedance-adapter and circuit separating transformer having a primary connected to said modulating means and a seconary connected to said winding.

5. A system for the transmission of data along the rails of a railway track through a plurality of successive, contiguous zones, said data transmitted to a train passing along said track in a given direction of travel, said system comprising:

(1) a plurality of resonance circuits, each connected across the rails of said track, pairs of said resonance circuits defining said zones therebetween, and said zones being independent of a block system of said railway track, (2) an alternating current generator for each zone having a predetermined frequency outside frequency bands of said block system, said predetermined frequency producing a carrier frequency for the data to be transmitted, (3) for each given zone, said pairs of said resonance circuits defining the given zone tuned to the carrier frequency of said generator within said given zone, (4) means for modulating said carrier frequency for each zone corresponding to the data to be transmitted, thereby providing data signals for each zone, (5) a plurality of insulated conductive windings in the form of conductive loops, one of said windings within each zone and positioned between the rails of the tracks adjacent the upstream side of each zone with respect to the direction of train travel, for each given zone said one winding positioned immediately proximate one of said pairs of resonance circuits of said given zone and remote from the other of said pair of resonance circuits of said given zone, (6) means for coupling the winding within each zone to receive the data signals from the modulating means for each zone, and (7) a receiver mounted onboard said train at a position near the rearward end of said train along the direction of travel of said train, said receiver tuned to the respective carrier frequencies of each zone for receiving said data signals of each zone.

6. A system as recited in claim 5 wherein said predetermined frequencies of each zone are all equal.

7. A system as recited in claim 5 wherein said predetermined frequencies of each zone are all different.

8. A system as recited in claim 5 wherein for each zone, said coupling means comprises an impedance-adapter and circuit separating transformer having a primary connected to said modulating means and a secondary connected to said winding.

9. A system for the transmission of data along the rails of a railway track through a zone thereof, said data transmitted to a train passing along said track in a given direction of travel, said system comprising:

(1) two resonance circuits, each connected across the rails of said track, said resonance circuits defining said zone and said zone being independent of a block system of said railway track, one resonance circuit connected at the downstream end of said zone relative to the direction of train travel, and the other resonance circuit connected at the upstream end of said zone, (2) an alternating current generator for said zone having a predetermined frequency outside frequency bands of said block system, said predetermined frequency producing a carrier for the data to be transmitted, (3) each of said resonance circuits tuned to the carrier frequency of said generator, (4) means for modulating said carrier frequency for said zone corresponding to the data to be transmitted, thereby providing data signals for said zone, (5) an insulated conductive winding in the form of a conductive loop, said winding within said zone and positioned between the rails of said tracks acjacent the downstream side of said zone with respect to the direction of train travel, said winding positioned immediately proximate said downstream resonance circuit and remote from said upstream resonance circuit, (6) means for coupling the winding within said zone to receive the data signals from the modulating means of said zone, and (7) a receiver mounted onboard said train at a position near the forward end of said train along the direction of travel of said train, said receiver tuned to the carrier frequency of said zone for receiving said data signals of said zone.

10. A system as recited in claim 9 wherein for each zone, said coupling means comprises an impedance-adapter and circuit separating transformer having a primary connected to said modulating means and a secondary connected to said winding.

11. A system for the transmission of data along the rails of a railway track through a zone thereof, said data transmitted to a train passing along said track in a given direction of travel, said system comprising:

(1) two resonance circuits, each connected across the rails of said track, said resonance circuits defining said zone and said zone being independent of a block system of said railway track, (2) an alternating current generator for said zone having a predetermined frequency outside frequency bands of said block system, said predetermined frequency producing a carrier frequency for said data to be transmitted, (3) each of said resonance circuits tuned to the carrier frequency of said generator, (4) means for modulating said carrier frequency for said zone corresponding to the data to be transmitted, thereby producing data signals for said zone, (5) an insulated conductive winding in the form of a conductive loop, said winding within said zone and positioned between the rails of said tracks adjacent the upstream side of said zone with respect to the direction of train travel, said winding position immediately proximate said upstream resonance circuit and remote from said downstream resonance circuit, (6) means for coupling the winding within said zone to receive the data signals from the modulating means of said zone, and (7) a receiver mounted onboard said train at a position near the rearward end of said train along the direction of travel of said train, said receiver tuned to the carrier frequency of said zone for receiving said data signals of said zone.

12. A system as recited in claim 11 wherein for each zone, said coupling means comprises an impedance adapter and circuit separating transformer having a primary connected to said modulating means and a secondary connected to said winding.

* * * * *